US005442919A

United States Patent [19]

Wilhelm

[11] Patent Number: 5,442,919

[45] Date of Patent: Aug. 22, 1995

[54] REHEATER PROTECTION IN A CIRCULATING FLUIDIZED BED STEAM GENERATOR

[75] Inventor: Bruce W. Wilhelm, Enfield, Conn.

[73] Assignee: Combustion Engineering, Inc., Windsor, Conn.

[21] Appl. No.: 173,563

[22] Filed: Dec. 27, 1993

[51] Int. Cl.[6] ..... F01K 7/24

[52] U.S. Cl. ..... 60/646; 60/653; 60/658; 60/663; 60/679

[58] Field of Search ..... 60/646, 653, 658, 663, 60/679

[56] References Cited

U.S. PATENT DOCUMENTS

| | | | |
|---|---|---|---|
| 2,579,027 | 12/1951 | Walter et al. | 60/658 |
| 2,884,760 | 5/1959 | Buri | 60/663 |
| 4,455,836 | 6/1984 | Binstock et al. | 60/663 |
| 4,576,008 | 3/1986 | Silvestri, Jr. | 60/663 |
| 4,748,940 | 6/1988 | Hönig | 122/4 D |
| 4,779,574 | 10/1988 | Nilsson et al. | 60/655 |
| 5,273,000 | 12/1993 | Regan | 122/4 D |

FOREIGN PATENT DOCUMENTS

| | | | |
|---|---|---|---|
| 0217709 | 12/1983 | Japan | 60/658 |

*Primary Examiner*—Ira S. Lazarus
*Assistant Examiner*—L. Heyman
*Attorney, Agent, or Firm*—Chilton, Alix & Van Kirk

[57] ABSTRACT

The final reheater in a circulating fluidized bed combustion system which is located in a separate fluidized bed heat exchanger and which would be subjected to hot solids without any cooling after a blackout or turbine is cooled by bleeding a portion of the steam from the superheater outlet through a normally closed high pressure drop valve and into the final reheater. A valve downstream from the final reheater is also opened to permit flow.

4 Claims, 1 Drawing Sheet

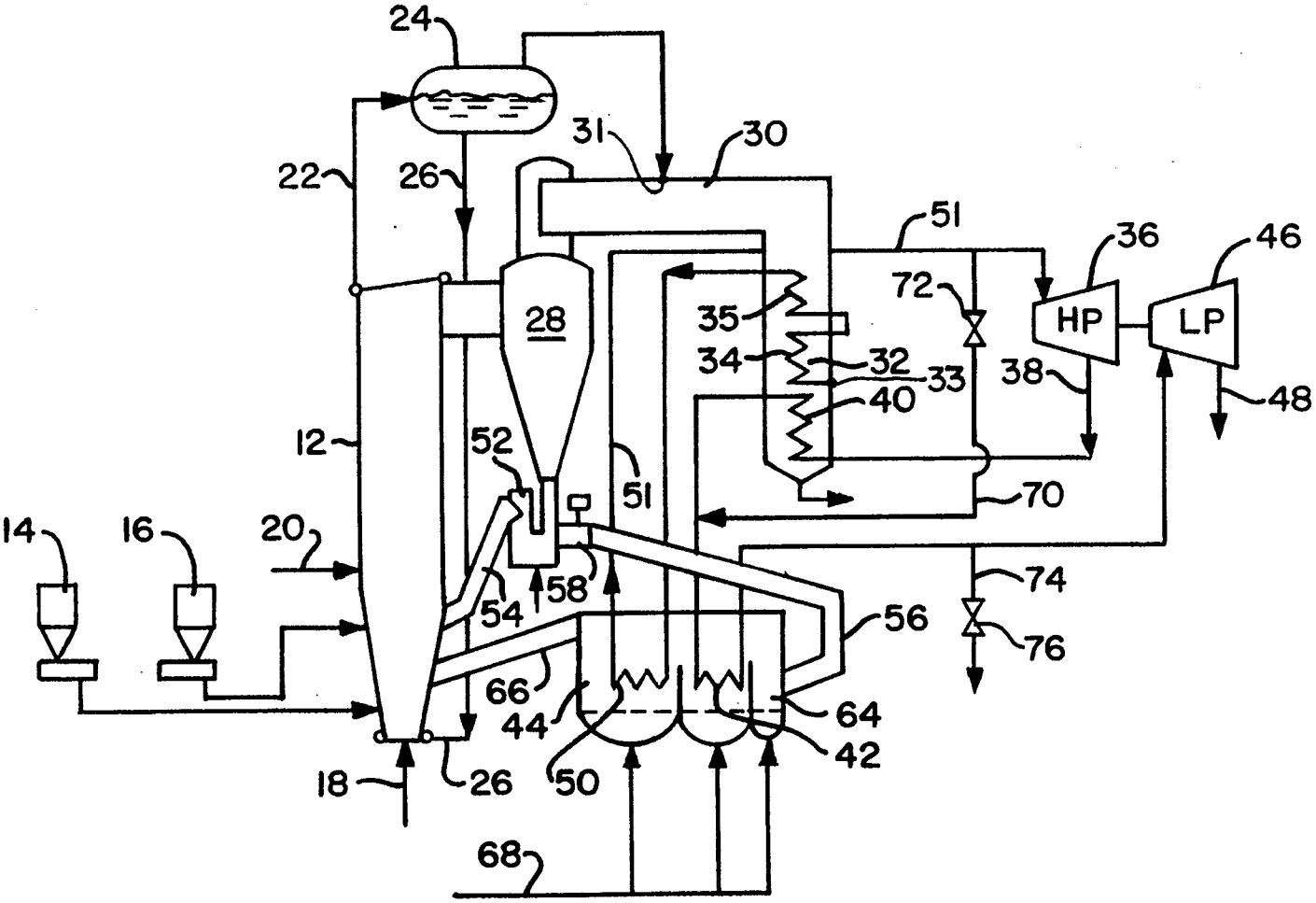
LP
HP
46
48
36
38
70
74
76
51
72
33
32
40
56
64
42
30
35
34
31
51
28
58
50
52
54
66
44
26
68
24
26
22
12
20
18
16
14

REHEATER PROTECTION IN A CIRCULATING FLUIDIZED BED STEAM GENERATOR

BACKGROUND OF THE INVENTION

The present invention relates to a method for protecting the reheater surface of a circulating fluidized bed combustion system during an upset condition in which fluid flow to the reheater is interrupted.

Fluidized bed combustion has gained favor for a number of reasons. An outstanding feature is its ability to burn high-sulfur fuels in an environmentally acceptable manner without the use of flue-gas scrubbers. In fluidized-bed combustion, much of the sulfur contained in the fuel is removed during combustion by a sorbent material in the fluid bed, usually limestone. In this process, the production of nitrogen oxides is low because of the low temperature at which the combustion reaction takes place.

One type of fluidized bed combustion is the circulating fluidized bed system. In this system, the gas velocities in the furnace are three to four times as high as in conventional bubbling fluidized bed system. The small solid particles are carried up through the furnace and a uniform lower-density gas/solids mixture exists throughout the entire furnace. Since the solids move through the furnace at much lower velocities than gas, significant solids residence times are obtained. The long residence time coupled with the small particle size produce high combustion efficiency and high sulfur oxide removal with lower sorbent limestone feed.

In the circulating fluidized bed combustion system, the solids which are carried from the furnace are separated from the gas by a cyclone. The solids discharged from the bottom of the cyclone pass through a seal pot or syphon seal. In some designs, a portion of the solids can be directed to a fluid bed heat exchanger with the remainder being reinjected directly back into the furnace. The heat extracted from the solids in the fluid bed heat exchanger may be used to provide additional evaporation, superheat and/or reheat.

In order to prevent excessive moisture from forming in the low pressure steam turbine stages, it is conventional to interrupt the expansion process, remove the steam for reheating at constant pressure, and return it to the low pressure turbine stages. This is known as a reheat cycle. In a circulating fluidized bed system, this reheat may be preformed in the convection pass of the furnace, in the fluid bed heat exchanger or a combination of these. When the heat recovery fluid bed system is used for reheat, either alone or in combination with reheat in the convection pass, a problem exists when there is an upset condition, such as the loss of power or turbine trip, where fluid flow to the reheater is interrupted but where the reheater surface continues to be exposed to a heat source.

SUMMARY OF THE INVENTION

An object of the present invention is to provide fluid flow to the reheater in the fluid bed heat exchanger of a circulating fluidized bed combustion system when normal flow is interrupted. More specifically, the invention involves diverting steam flow from the primary circuit, after the finishing superheater, to provide fluid flow to the reheater when there is a loss of power or turbine trip such that the normal reheater fluid flow is interrupted.

BRIEF DESCRIPTION OF THE DRAWING

The drawing shows an overall circulating fluidized bed combustion system including the reheater protection system of the present invention.

DESCRIPTION OF THE PREFERRED EMBODIMENTS

Referring to the drawing, a typical circulating fluidized bed combustion system is illustrated beginning with the fluidized bed furnace 12. Coal and limestone are fed to the furnace from the bins 14 and 16 respectively. The primary fluidizing air is fed to the air plenum chamber in the bottom of the furnace at 18 while secondary combustion air is fed at 20. The bottom of the furnace 12 is refractory lined for corrosion and erosion protection. The upper portion of the furnace 12 contains evaporative waterwalls. The steam generated in the waterwalls is fed via line 22 to the steam drum 24 while water is supplied to the waterwalls via line 26.

The solids carried from the furnace 12 along with the flue gas are separated from the flue gas in the cyclone separator 28. The solids are discharged from the bottom of the cyclone separator to be processed in accordance with the present invention as described hereinafter. The flue gas exits the top of the cyclone separator 28 in the duct 30 and passes through the convection section 32. The flue gas would then typically be treated in a dust collector and used to preheat the incoming combustion air before being passed to the stack.

Saturated steam leaves the drum 24 and enters the steam-cooled walls of duct 30 and the convection section 32 at point 31 and passes from these steam cooled walls at point 33 into and through the first convective tube bank 34 and enters the second convective tube bank 35 (in some designs this is the final superheater). Then the steam goes to the fluid bed heat exchanger for final superheat 50 and is passed to the high pressure turbine through line 51. The discharge 38 from the high pressure turbine 36 is passed to the initial reheater section 40 in the convection section 32 where the steam is partially reheated. From the reheater section 40, the steam is passed to the final reheater section 42 in the fluid bed heat exchanger 44 to be described hereinafter. The reheated steam is then fed to the low pressure turbine 46. The discharge 48 from the low pressure turbine 46 is then passed back to the boiler usually through an economizer section (not shown).

On the bottom of the cyclone separator 28 is a seal pot or syphon seal 52. This is a non-mechanical valve which moves solids collected in the cyclone separator back into the furnace 12 against the furnace pressure. Solids flow down on the inlet side, up the outlet side and then back to the furnace in duct 54. The bottom portion of this seal pot is normally fluidized so that material in the seal pot can seek different levels on each side. The difference in level corresponds to the pressure difference across the seal pot. Solids entering the inlet side then displace the solids flowing out on the outlet side.

Located in the lower portion of the seal pot 52 is a solids withdrawal pipe 56 including a solids flow control valve 58. This valve is variously referred to as a plug valve used to control the flow of solids. This valve 58 is used for the adjustment of the reheat steam temperature by controlling the quantity of hot solids which are withdrawn from the seal pot 52 and introduced into the external fluid bed heat exchanger 44.

The fluid bed heat exchanger 44 is a bubbling bed heat exchanger consisting of several compartments separated by weirs with the compartments containing immersed tube bundles previously referred to as final reheater section 42 and final superheater 50. The hot solids enter the heat recovery fluid bed system 44 through the duct 56 where they are fluidized and transfer heat to the heat exchange surface 42 and 50. The solids initially enter the solids distribution compartment 64 and gradually pass from one compartment to the next and then out through the outlet pipe 66 and back to the furnace 12. The fluidizing air for the heat recovery fluid bed system is supplied through line 68 and is fed to each compartment.

When there is a loss of power or a turbine trip, the flow of fuel, limestone and air to the furnace 12 are cut-off. The feedwater flow may or may not continue but flow through the waterwalls and superheater continues with depressurization. Although fluid flow through the primary circuit (waterwalls, superheater, etc.) continues, there is no further flow of fluid coming out of the high pressure turbine and through the initial reheater section 40 and final reheater 42. Since the solids in the non-fluidized state do not cover all the reheater surface in the fluid bed heat exchanger, tubes submersed in the solids heat-up and expand at a different rate than the un-submersed tubes. The present invention provides for fluid flow through the final reheater 42 when normal reheater circuit flow is interrupted to prevent un-equal heating of the reheater metals.

Since there is still fluid flow through the primary circuit after a trip or blackout, there is a continued source of fluid (steam or water) available at the outlet of the final superheater 50. Therefore, a line 70 with a valve 72 connects the outlet line 51 of the final superheater 50 to the inlet of the final reheater 42. The valve 72 is a power actuated valve, normally closed and is designed to fall open on loss of power. The valve has a high pressure drop so that when it opens, the high pressure steam from the superheater at perhaps 2270 psig and 1005° F. is reduced to perhaps 700 psig and 930° F. These temperatures and pressures are merely by way of example and are not meant to be limitations on the invention. The line 70 and valve 72 are designed to supply a fraction of the steam from the superheater to the reheater that is sufficient to accomplish the reheater cooling. For example, about 7 to 10% of the steam flowing out of the superheater may be sufficient but this will depend on the particular design of each fluidized bed plant.

In order to obtain proper flow of this diverted steam through the final reheater, an atmosphere vent or drain line 74 and valve 76 are located downstream of the final reheater 42. The valve 76, like valve 72, is designed to be normally closed and to open along with valve 72 upon a blackout or turbine trip. Opening this valve 76 permits the free flow of steam through the final reheater. The steam will remove heat from the final reheater and help maintain uniform and acceptable tubing thermal expansion and allow the boiler to safely depressurize without the need for electrical power.

I claim:

1. A method of operating a circulating fluidized bed combustion system wherein said system comprises a circulating fluid bed furnace, a fluid bed heat exchanger separate from said circulating fluid bed furnace and adapted to receive circulating fluidized solids from said circulating fluid bed furnace, a superheater circuit and a reheater circuit wherein said reheater circuit carries a normal reheater fluid flow and at least a portion of said reheater circuit is located in said fluid bed heat exchanger for heat exchange contact with said circulating fluidized solids comprising the steps of:

a. firing said circulating fluid bed furnace;

b. separating circulating fluidized solids from flue gases exiting said circulating fluid bed furnace;

c. feeding said separated circulating fluidized solids to said fluid bed heat exchanger for heat exchange contact with said portion of said reheater circuit;

d. determining a condition which causes said firing to terminate and the reheater fluid flow to terminate;

e. opening a valve upon determining said condition and feeding fluid from said superheater circuit to said portion of said reheater circuit in said fluid bed heat exchanger; and f. opening a vent downstream from said portion of said reheater circuit to permit flow of fluid from said superheater circuit through said portion of said reheater circuit thereby cooling said portion of said reheater circuit.

2. A method as recited in claim 1 wherein said fluid is steam.

3. A method as recited in claim 2 wherein the pressure of said steam from said superheater circuit is reduced prior to entering said portion of said reheater circuit.

4. A method as recited in claim 3 wherein said pressure is reduced in said valve.

* * * * *